United States Patent [19]

Hoffmann

[11] 4,108,709

[45] Aug. 22, 1978

[54] LABEL APPLYING MACHINE

[75] Inventor: Wolfgang Hoffmann, Modesto, Calif.

[73] Assignee: B & H Manufacturing Company, Inc., Ceres, Calif.

[21] Appl. No.: 695,805

[22] Filed: Jun. 14, 1976

[51] Int. Cl.[2] ..... B65C 3/12

[52] U.S. Cl. ..... 156/446; 156/215; 156/456; 156/458

[58] Field of Search ..... 156/446, 212, 215, 456, 156/458, DIG. 13, DIG. 25, DIG. 26

[56] References Cited

U.S. PATENT DOCUMENTS

| | | | |
|---|---|---|---|
| 961,270 | 6/1910 | Tucker | 156/456 |
| 1,010,030 | 11/1911 | Feibusch | 156/456 |
| 1,445,321 | 2/1923 | Johnson et al. | 156/456 |
| 2,495,174 | 1/1950 | McClatchie | 156/456 X |

FOREIGN PATENT DOCUMENTS

| | | | |
|---|---|---|---|
| 688,813 | 3/1953 | United Kingdom | 156/DIG. 13 |

*Primary Examiner*—David A. Simmons
*Attorney, Agent, or Firm*—Edward B. Gregg

[57] ABSTRACT

Machine for applying labels to cylindrical containers such as metal cans wherein labels on a vacuum drum and/or containers on a turret have an adhesive applied thereto and each label is attached to a container and is wrapped around the container by rotating the container. The containers are supplied by a rotary turret and are rotated with the turret from an entry point to an exit point between which the labels are applied. Each container, in addition to its planetary motion about the turret axis, is rotated about its own axis to speed up the application of labels. The capacity of a machine is thereby increased because the containers can be packed closer together without interference between label attached to one container but not yet wrapped around the container being interfered with by the next container.

6 Claims, 3 Drawing Figures

LABEL APPLYING MACHINE

Figure 1:
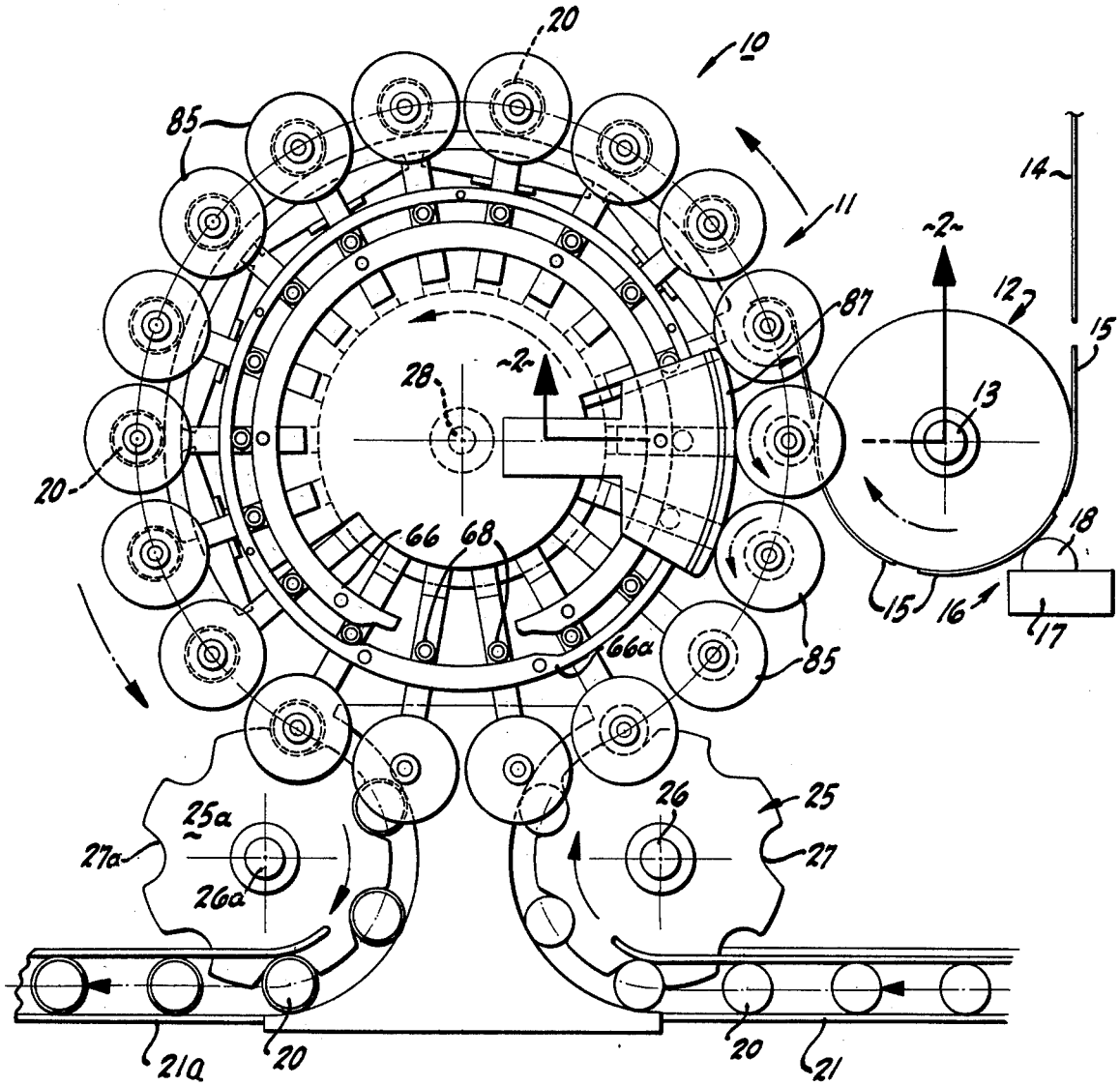

This invention relates to a machine for applying labels to cylindrical containers such as metal cans, fiberboard containers, glass containers, plastic containers and other containers and objects having a cylindrical shape.

In my U.S. Pat. No. 3,834,963, filed Feb. 14, 1972, issued Sept. 10, 1974, and entitled "METHOD FOR APPLYING LABELS TO CONTAINERS" and also in my co-pending application, Ser. No. 480,044, filed June 17, 1974, entitled "APPARATUS FOR APPLYING LABELS TO CONTAINERS", I have described and claimed label applying machines in which individual labels are severed continuously from a continuous web of label material and each severed label is picked up by a vacuum drum and is transported to a point of application to the respective container. Meanwhile, the containers are caused to travel through a predetermined path, for example around a turret axis, such path being tangent to the aforesaid point of application. As described in my aforementioned patent and patent application, a glue applicator applies glue to the trailing edge of each label while it is on the vacuum drum and a second glue applicator applies glue to each container, the timing being such that when each container reaches the aforesaid tangent point, it is brought into contact with the leading edge of a label, which is attached to the container by means of the glue applied to the container. During transit from the point of application of glue to the container to the aforesaid tangent point, each container is clamped by chucks and is held stationary except for its planetary movement around the turret. That is to say, the containers do not spin during this interval about their individual axes but undergo only planetary motion about the turret axis. Thereafter, that is to say, after attachment of a label, the clamping action is terminated and the containers are caused to roll so as to wrap the labels about them.

A difficulty with this apparatus is that the spacing must be such that the trailing edge of each label as it is attached to a container must not be interfered with by the next succeeding container. If space is not an object, this can be dealt with satisfactorily by making the machine sufficiently large that the containers are spaced sufficiently far apart to avoid such interference.

It is an advantage, however, in many situations to have a machine of the type described in my aforesaid patent and patent application but in which the containers are packed closer together. If this can be done without the aforesaid label interference, then a machine of a given size will have a greater capacity.

It is an object of the present invention to improve upon the wrap around label applying machines such as those of my aforesaid patent and patent application.

It is a further object of the invention to provide means whereby the containers may be packed closer together than heretofore and yet do not encounter label interference of the character described.

The above and other objects of the invention will be apparent from the ensuing description and the appended claims.

Figure 2:
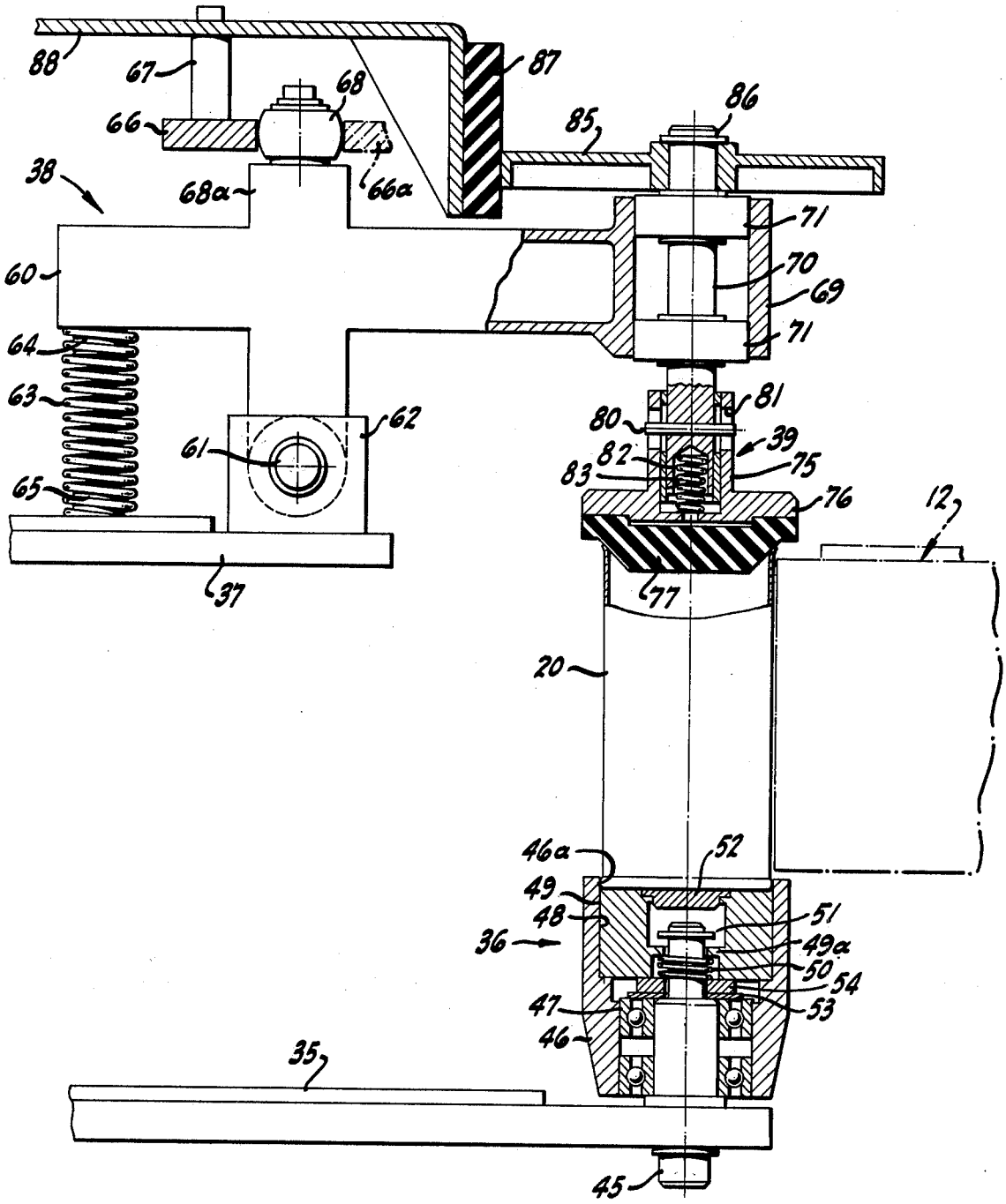
Figure 3:
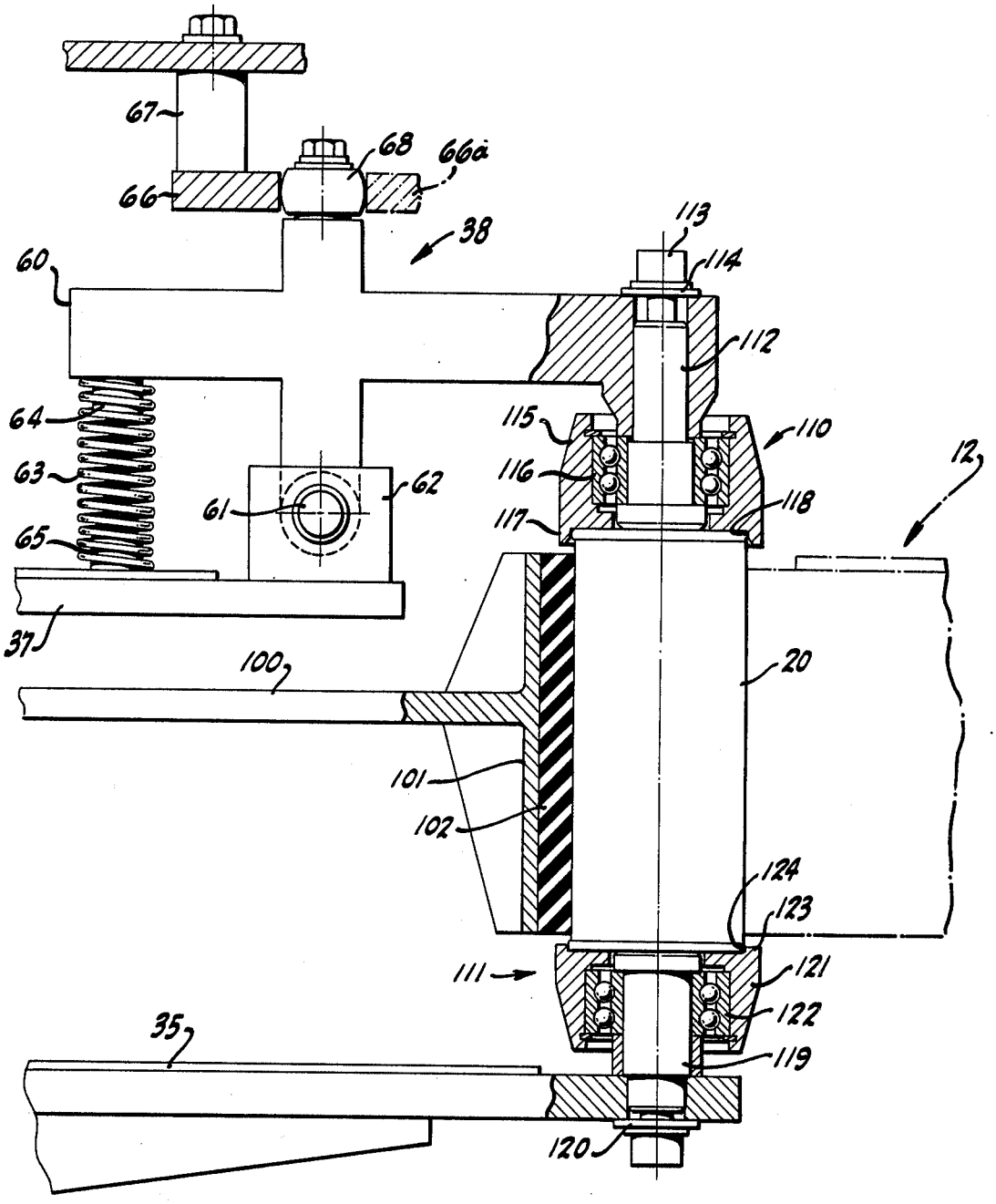

Certain embodiments of the invention are illustrated by way of example in the accompanying drawings, in which:

FIG. 1 is an end elevational view of the apparatus of the present invention showing the vacuum drum which picks up labels, the turret which transports the labels and entry and exit apparatus;

FIG. 2 is a section taken along the line 2—2 of FIG. 1 showing details of the chuck assembly and of the means whereby one of the chucks is rotated so as to spin the container and thereby give it an incremental speed such that the containers can be packed closer together without the aforesaid label interference; and FIG. 3 is a similar view but of a modification in which the containers are rotated by direct contact of their peripheries with a stationary pad.

Referring now to FIG. 1, the machine is generally designated by the reference numeral 10 and it comprises a turret 11 and a vacuum drum 12. The vacuum drum 12 rotates on an axle or stub shafts, one of which is shown at 13. A fragment of a continuous web of label material is shown at 14, which is severed by suitable instrumentalities (not shown) into individual label strips 15. Suitable continuous label severing devices are described in my aforesaid patent and patent application. It is not necessary that the label strips be continuously cut from a continuous web; pre-cut labels may be used. However, continuous severing of labels as in my patent and patent application is preferred. The vacuum drum 12 may have, and preferably has, a construction such as described in my aforesaid patent and patent application including vacuum means to grip the leading end of each label by vacuum and hold it on the drum until it is attached to a container. Preferably also, the vacuum drum comprises a series of lands or raised portions to which the trailing edge of each label is applied. Such construction is shown in my aforesaid patent and patent application and requires no further description herein. Such features are preferred but they are not necessary for purposes of the present invention.

Also shown in FIG. 1 is a glue applicator 16 comprising a trough 17 and a glue wheel or cylinder 18. Operation of such glue applicator may be in accordance with known construction, for example that described in my aforesaid patent and patent application. In the particular instance shown, the entire inner surface of each label is coated with glue. (The term "inner surface" refers to the surface on the label which is in contact with the container, whereas on the drum, of course, this surface is the outer surface.) Alternatively, glue may be applied to the containers or glue may be applied to a predetermined area of the container and to the trailing edge of the label so that each label is adhered at its leading edge to the glue line on the container and the glued trailing edge overlaps and is adhered to the leading edge of the label on the container.

The containers are shown at 20 as coming in from the right through a conveyor 21 to a star wheel 25 rotatable on an axle 26 and having pockets 27 for receiving the containers in succession and rotating them counterclockwise as viewed in FIG. 1 until they are picked up by a chuck assembly as described hereinafter. After a label has been applied to and wrapped around a container, it is delivered by the turret 11 to a star wheel **25*a* and exit conveyor 21*a***.

Referring to FIGS. 1 and 2, the turret assembly 11 rotates on an axle 28 to which are attached and from which radiate lower arms 35, each of which supports a lower chuck assembly 36 (see FIG. 2) and upper arms 37 directly overlying the lower arms 35. Each of the upper arms 37 supports a pivot assembly 38 on the outer end of which is mounted an upper chuck assembly 39 which is aligned with the respective lower chuck assembly.

The lower chuck assembly 36 comprises a shaft 45 mounted on the outer end of the arm 35 and supporting a housing 46. Bearings 47 are provided such that the housing 46 is freely rotatable. Within the enlarged upper end 48 of the housing 46, there is a chuck member 49 formed with an inner annular shoulder 49*a* which rests on an expansion spring 50. A keeper ring 51 affixed to the upper end of the shaft 45 limits vertical movement of the chuck member 49 but allows such movement in a limited fashion. A plug 52 is seated in the upper end of the central cavity of the chuck member 49, which is removable for access. A thrust washer 53 and lubricating seal 54 are provided.

A container 20 is shown seated on the chuck member 49 which is depressed below the rim of the housing 46 so that a cup is formed to receive the lower end of the container. It is the downward force of the upper chuck (as explained hereinafter) which depresses the container 20 below the rim of the housing 46. When no such force is applied (for example, when a container is first transferred to a chuck and when a container with a label wrapped around it is removed from the turret), the spring 50 acts to lift and hold the chuck member 49 level with the rim of the housing 46 so that there is no obstruction to transfer of containers to and from the chucks. This is especially important at high speed.

The pivot assembly 38 on each arm 37 comprises a pivot arm 60 pivotally mounted by means of a pin 61 on one or more brackets 62. An expansion spring 63 held in place by pins 64 and 65 on the pivot arm 60 and on the radial arm 37, respectively, acts to urge the pivot arm 60 in a counterclockwise direction as viewed in FIG. 2. Also shown in FIG. 2 are two cams 66 and 66*a*. The inner cam 66 is suported from the frame of the machine by brackets 67. The outer cam 66*a* is similarly supported. As shown in FIG. 1, inner cam 66 is nearly 360° and cam 66*a* is 360° in extent. The cruciform pivot arm 60 is provided with a cam follower roller 68 rotatably mounted on a stub shaft 68*a*. At its outer end the pivot arm 60 is formed with a sleeve 69. Within the sleeve 69 there is a shaft 70 rotatable in bearings 71 which are fixed to the sleeve 69. At its lower end, the shaft 70 is received in a sleeve 75, the lower end of which is integral with a chuck member 76 having a frusto-conical pad 77 for reception, as shown, in the upper end of an open container. Limited movement of the sleeve 75, chuck member 76 and pad 77 are permitted by reason of a pin 80 movable in slots 81 in the sleeve 75. A spring 82 under compression is received in a socket 83 in the lower end of shaft 70 and it urges the chuck 76 and pad 77 downwardly but allows limited upward movement.

The spring 82 exerts a downward pressure exceeding the upward pressure of the spring 50 such that, when a container is clamped between the upper and lower chucks, as shown in FIG. 2, the chuck member 49 is depressed below the rim of housing 46 to form a cup or socket 46*a* to receive and safely hold the container 20.

A wheel 85 is mounted on the upper end of the shaft 70 and is held in place by keeper rings 86. The wheel 85 contacts a pad 87 of suitable resilient material such as rubber or polyurethane, such being mounted on a bracket 88 which is fixed to the frame of the machine.

As shown in FIG. 1, the pad 87 is arcuate (being a sector of a circle having the axis of the turret 11 as its center) and it is so located with reference to the vacuum drum 12 that the wheel 85, and with it the shaft 70 and chuck 76, therefore also the container 20, are caused to rotate about the axis of the shaft 70. This motion occurs as a label is attached to and is wrapped around the container. This so speeds up the wrap-around operation that before the next container moves to a position where it might interfere with the label being applied to the immediately preceding container, that label is wrapped around the container to a sufficient degree that it is out of the way and is not interfered with by the next container.

The function of the cams 66 and 66*a* is as follows: As each container is delivered to the turret, the outer cam 66*a* acts on the follower 68 associated with the respective pivot arm 60 and, because at this point there is a gap in the inner cam 66 the outer cam acts to rotate the pivot arm 60 clockwise as viewed in FIG. 2 and therefore holds the respective chuck 76 and pad 77 above and clear of a container. As the rotation proceeds, the inner cam 66 comes into play and urges the pivot arm 60 counterclockwise and engages the chuck with the container. At the exit point, the reverse action occurs; that is, inner cam 66 releases the follower 68 and the outer cam 66*a* acts to pivot the chuck clear of the container to allow it to be removed from the turret by the star wheel 25*a*.

Referring now to FIG. 3, a different means for rotating the chucks and containers is employed. The pivot assembly 38 is the same as in FIG. 2. In the embodiment of FIG. 3, instead of rotating the container by means of a wheel such as shown at 85 and a pad such as shown at 87, as shown in FIG. 2, a bracket 100 affixed to the frame carries at its outer end an arcuate plate 101 to which a pad 102 of suitable resilient material is affixed. It will be apparent that as each container in turn reaches and is held in contact with the pad 102, frictional engagement between the two will cause rotation of the can, the effect of which is as described above in connection with FIG. 2. The plate 101 and pad 102 are arcuate and are located like the pad 87 in FIG. 2.

Aside from the means for rotating the containers, the embodiment of FIG. 3 differs from that of FIG. 2 also in details of construction of the chucks. The embodiment of FIG. 2 is better suited to labeling of empty containers. Empty containers are more fragile than filled containers; therefore, the chuck pad 77 is shaped and sized to fit within the open top of an empty container to stabilize it and to center it. Further, in FIG. 2 because of the fragile character of the empty containers, they are rotated by a wheel 85 bearing against pad 87. The only pressure applied to the empty containers is an axial pressure, which is in the direction of greatest strength. In the case of filled containers having a top closure as well as being filled, the cans are sturdier and can sustain rougher treatment. Therefore, direct contact between the container and a pad such as that shown at 102 is possible and it simplifies construction. However, it will be apparent that the construction of FIG. 2 may be employed with filled containers and it will also be apparent that if empty containers are of sturdy enough construction, the construction of FIG. 3 may be employed.

In FIG. 3, the same pivot arm 60, etc. are employed as in FIG. 2 but the chuck assemblies 110 (top) and 111 (bottom) are different and are simpler. The upper chuck assembly comprises a shaft 112 extending through the outer end of pivot arm 60 and is secured in place by a nut 113 and washer 114. This shaft extends through a chuck member 115 and bearings 116. The lower end of the chuck member 115 has a rim 117 which forms a cup 118 to receive the upper end of a closed container 20. Lower chuck assembly 111 includes a shaft 119 carried in the outer end of arm 35 and held there by a retainer ring 120. A chuck member 121 rotatable in bearings 122 is provided. The upper end of chuck member 121 is formed with a rim 122 which forms a cup 123 to receive the lower end of the container 20.

Operation of the chuck assemblies 110 and 111 will be apparent from the description with reference to FIG. 2, the same cam arrangement being employed.

It will be apparent that the container carrier need not be a turret. For example a straight line conveyor may be employed in which labels are attached to containers in succession by any suitable label applicator and a wheel such as that shown at 85 is rotated frictionally or by a rack and pinion, or the containers are contacted with a planar friction surface.

It will, therefore, be apparent that a new and useful label applying machine and method have been provided.

I claim:

1. Labeling apparatus for applying labels at high speed to cylindrical containers comprising:

(a) a cylindrical rotary drum having means for gripping the leading end of a label at a label supply station, holding the label on the cylindrical surface of the rotating drum, conveying the label so held to a label applying station and releasing the label to a container at such station, (b) a container feed for supplying cylindrical containers in rapid succession and in closely spaced array to said label applying station and in tangent contact with the labels at such station, said container feed including means for positively gripping the opposite ends of each container but allowing the container to rotate about its cylinder axis and (c) container rotating means for rotating each container about its cylinder axis just before and at the time of first contact of the container with the leading edge of a label and during the time that the label is being wrapped around the container, said rotating means acting to cause the leading edge of the label on the drum and the surface of the container tangent to the label to move in the same direction at the instant of contact of the leading edge of the label with the container.

2. The apparatus of claim 1 wherein the container feed is in the form of a rotary turret and the drum is a vacuum drum which attaches and holds labels by vacuum and which releases each label in turn at the time of contact of the label with a container at the label applying station.

3. The apparatus of claim 2 wherein the container gripping means is in the form of a pair of opposed rotatable chucks which bear against opposite ends of the container.

4. The apparatus of claim 3 in which said container rotating means is provided with chuck driving means for driving one of the chucks to cause rotation of the container about its cyliner axis.

5. The apparatus of claim 4 wherein said chuck driving means is in the form of a wheel driving the rotating chuck and a frame member bearing against the wheel and causing it to rotate.

6. The apparatus of claim 2 wherein the container rotating means is in the form of a frame member bearing against the cylindrical surface of the container on the side of the container remote from the vacuum drum.

* * * * *